US008342292B2

(12) United States Patent
Demma

(10) Patent No.: US 8,342,292 B2
(45) Date of Patent: Jan. 1, 2013

(54) ADDRESS ASSIGNMENT OF ELEVATOR OPERATING UNITS

(75) Inventor: Beniamino Demma, Giubiasco (CH)

(73) Assignee: Inventio AG, Hergiswil (CH)

( * ) Notice: Subject to any disclaimer, the term of this patent is extended or adjusted under 35 U.S.C. 154(b) by 313 days.

(21) Appl. No.: 12/450,752

(22) PCT Filed: Apr. 10, 2008

(86) PCT No.: PCT/EP2008/054369

§ 371 (c)(1),
(2), (4) Date: Mar. 3, 2010

(87) PCT Pub. No.: WO2008/122669

PCT Pub. Date: Oct. 16, 2008

(65) Prior Publication Data

US 2010/0147630 A1 Jun. 17, 2010

(30) Foreign Application Priority Data

Apr. 10, 2007 (EP) ..... 07105883

(51) Int. Cl.
*B66B 1/28* (2006.01)

(52) U.S. Cl. ..... 187/247; 187/391

(58) Field of Classification Search ..... 187/247, 187/248, 380–388, 391–393
See application file for complete search history.

(56) References Cited

U.S. PATENT DOCUMENTS

| | | | | |
|---|---|---|---|---|
| 3,828,892 | A * | 8/1974 | Winkler et al. | 187/380 |
| 4,193,478 | A * | 3/1980 | Keller et al. | 187/247 |
| 4,766,978 | A | 8/1988 | Blain et al. | |
| 4,860,207 | A * | 8/1989 | Kubo | 187/247 |
| 6,450,298 | B1 * | 9/2002 | Koura et al. | 187/247 |
| 6,471,011 | B1 * | 10/2002 | Ando et al. | 187/247 |
| 6,672,429 | B1 | 1/2004 | Thurmond, III | |
| 6,708,801 | B2 * | 3/2004 | Nakai | 187/382 |
| 7,552,801 | B2 * | 6/2009 | Trifu | 187/391 |
| 8,134,448 | B2 * | 3/2012 | Oster et al. | 340/3.1 |
| 2009/0288919 | A1 * | 11/2009 | Flynn et al. | 187/247 |
| 2011/0120808 | A1 * | 5/2011 | Fang et al. | 187/247 |
| 2011/0120813 | A1 * | 5/2011 | Flynn et al. | 187/384 |

FOREIGN PATENT DOCUMENTS

| | | | |
|---|---|---|---|
| EP | 0 367 388 | A1 | 5/1990 |
| JP | 2006 225068 | A | 8/2006 |

* cited by examiner

*Primary Examiner* — Anthony Salata
(74) *Attorney, Agent, or Firm* — Wolff & Samson, PC

(57) ABSTRACT

The invention relates to a method for setting up a number of operating units in a lift system having a number of floors. The operating units are connected in series. A first operating unit is connected to a central controller, and at least one operating unit is provided on each floor. Configuration data with an address data packet is sent from the controller to the operating units. The address data packet has a number of addresses, which permits the fixing of an address for each operating unit. The invention further relates to a lift system for carrying out the method.

16 Claims, 2 Drawing Sheets

ADDRESS ASSIGNMENT OF ELEVATOR OPERATING UNITS

CROSS REFERENCE TO PRIOR APPLICATION

This is a U.S. national phase application under 35 U.S.C. §371 of International Patent Application No. PCT/EP2008/054369, filed Apr. 10, 2008, which is incorporated by reference herein in its entirety, and which claims benefit of European Patent Application No. 07105883.8, filed Apr. 10, 2007. The International Application was published in German on Oct. 16, 2008 as WO 2008/122669 A2 under PCT Article 21(2).

FIELD OF THE INVENTION

The present invention relates to an elevator system and more particularly to an elevator system having a large number of floors and a large number of operating units wherein at least one operating unit is allocated to each floor.

BACKGROUND OF THE INVENTION

In the context of assembling and installing an elevator system in a building, the elevator car is moved during a so-called learning trip to all stopping positions, that is to say to all floors, in order to set up the stopping positions at the height levels of the respective floors. Furthermore, the operating units distributed among the individual floors and the communication of said operating units with the central control unit have to be set up or configured. In this case, it is necessary to define or to order the operating units with regard to their position in a specific floor and with regard to their function, such that, during subsequent operation of the elevator system, the central control unit recognizes from which floor and from which operating unit a specific signal is communicated by the actuation of the operating unit by the user.

This setting up is conventionally performed by a fitter having to input data, for example by means of the elevator car panel, and having to manually set up each operating unit on each floor after moving to each floor. Configurations carried out in this way require a high expenditure in respect of time and personnel.

SUMMARY OF THE INVENTION

An object of the present invention is developing a method for setting up a large number of operating units of an elevator system in such a way that the configuration of the operating units is possible in a simple manner and in a shorter time.

In accordance with an embodiment of the present invention, a method is provided for setting up a large number of operating units of an elevator system having a large number of floors, wherein the operating units are connected in series and a first operating unit is connected to a central control unit, and wherein in each case at least one operating unit is allocated to a floor. The method comprises transmitting configuration data with an address data packet from the control unit to the operating units. The address data packet comprises a large number of addresses for respectively defining an address for each operating unit. The address is then stored in a storage unit of the operating units.

The present invention enables comparatively simple, preferably fully automatic, and rapidly performable setting up or configuration of the large number of operating units distributed along the floors. A complicated set-up method comprising moving to all the individual floors and manually setting up the operating units can thus be dispensed with. The method according to the invention merely has to be started and can then proceed fully automatically. In addition, possible error sources on account of manual settings can be reduced in this way.

For the purposes of the present invention, an "operating unit" is understood to mean the panel provided in the access area on each floor to the elevator system for destination call inputting and/or optical and/or acoustic indicator units for the use of the elevator system. Such an operating unit usually comprises at least one printed circuit board. However, two different printed circuit boards can be present on each floor, wherein one printed circuit board forms a destination call panel and the other printed circuit board forms an indicator unit.

A further aspect of the present invention provides for the addresses to be accommodated in the address data packet in a specific order and to be transmitted and/or stored in this order step by step in the storage units.

Each storage unit comprises a shift register, wherein the shift registers are connected in series and the respective address is stored in the respective shift register. In the case of shift registers of this type, the content of such a shift register can be shifted by one or a plurality of positions. Such a shift register can be composed of a plurality of circuits (flip-flops). A flip-flop of this type is bistable between the two states 0 and 1 and can be used for storing an item of information having a length of 1 bit.

The step-by-step storage can be effected in a manner dependent on a predetermined clock signal.

A further aspect of the present invention provides for each operating unit to transmit a check signal to the control unit. Said check signal can convey to the central control unit the fact that the respective operating unit is functional. In this way, after the conclusion of the set-up method, by means of the central control unit, it is possible to ascertain whether all the operating units are functional. If an operating unit is not functional and has not returned a check signal, the control unit outputs a corresponding signal giving notification that the setting up has failed. The non-functional operating unit can thereupon be exchanged and the configuration method can be started anew.

In a further aspect of the invention each operating unit transmits an identification signal for the designation of the operating unit or the properties thereof to the control unit. Said identification signal can comprise for example a type category or group category of the operating unit and identify for example a destination call panel or an indicator unit. This identification can be stored in the central control unit.

Each operating unit communicates a position data signal for the designation of a floor to the control unit. In this way, the central control unit recognizes which operating unit is present on which floor.

In a further aspect of the present invention at least two groups of operating units are provided, wherein a first group comprises a plurality of destination call panels and/or destination call terminals and a second group comprises a plurality of indicator units. With regard to the series connection of the operating units, in each case the operating units of one group or the operating units of a plurality of groups, preferably of all the groups, can be connected in series.

The present invention also relates to an elevator system for carrying out the methods and features described above.

These and other advantageous features and aspects of the invention are described below with respect to the Figures, Detailed Description, and the claims.

BRIEF DESCRIPTION OF THE DRAWINGS

The invention is explained in more detail below with reference to the drawings, in which.

DETAILED DESCRIPTION

Figure 1:
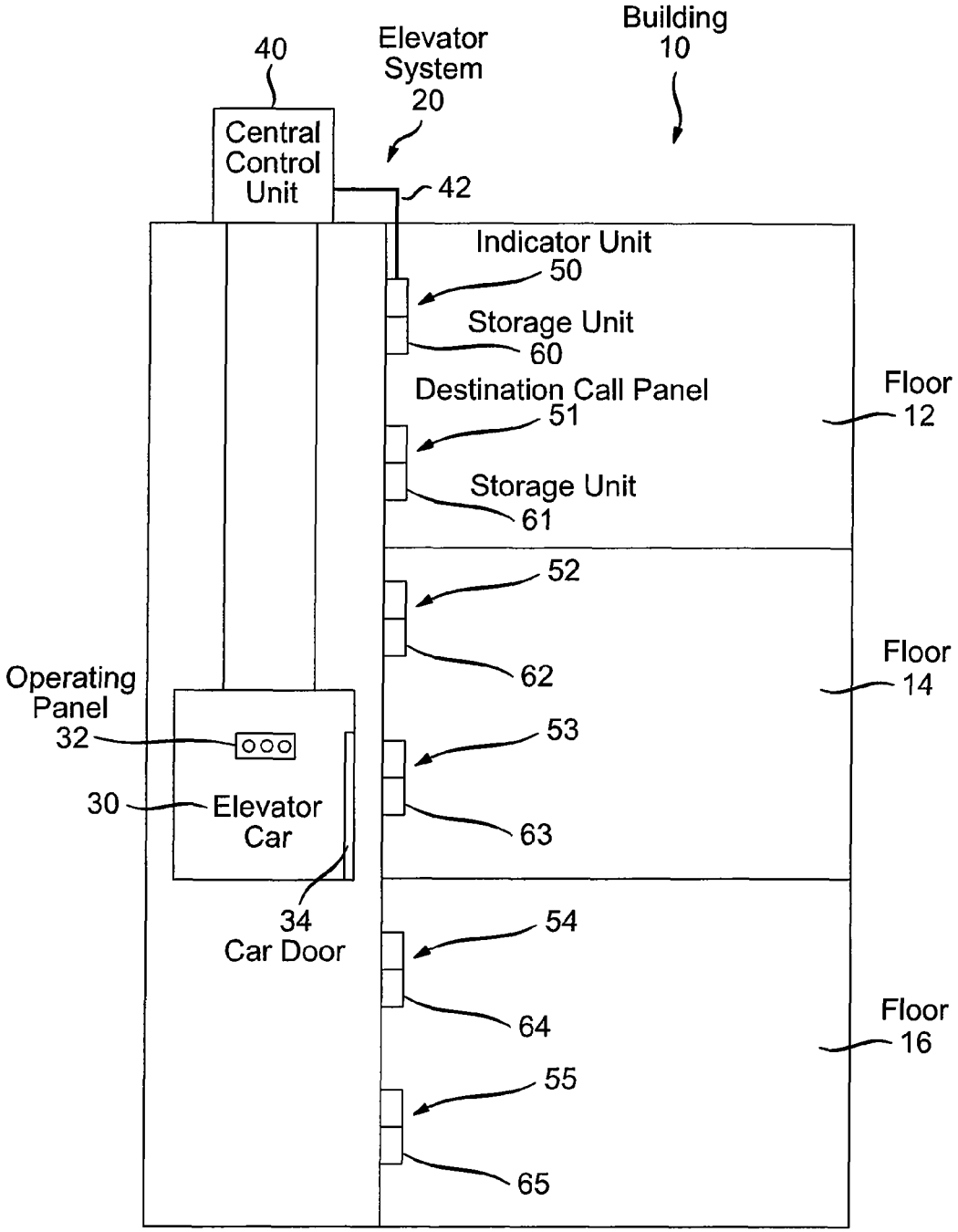
FIG. 1 shows an excerpt from a building with an elevator system with a large number of floors and operating units distributed among the floors.

FIG. 1 schematically shows an excerpt from a building 10 with an elevator system 20. The elevator system 20 comprises a vertically movable elevator car 30 having an operating panel 32 having a plurality of destination call switches and a car door 34. The operating panel 32 performs data interchange with a central control unit 40, which serves for controlling the elevator system 20. The building 10 has three floors 12, 14, 16. Situated on each of said floors 12, 14, 16 there is a respective access to the elevator system 20, which can be closed in each case by means of an access door.

In the area of each access, there are in each case two operating units on each floor 12, 14, 16. In detail, on the first floor 12 there are two operating units 50, 51, on the second floor 14 there are two operating units 52, 53, and on the third floor 16 there are two operating units 54, 55.

In this case, the operating units 51, 53 and 55 constitute destination call panels via which the user of the elevator system 20 can request the elevator car 30 and/or can issue a destination call. Each operating unit 51, 53, 55 comprises a respective storage unit 61, 63, 65 in the form of a respective shift register 71, 73, 75 and a plurality of destination call buttons.

Furthermore, in the area of each access, there is a second operating unit on each floor. These operating units, designated by the reference symbols 50, 52, 54 in FIGS. 1 and 2, constitute indicator units and comprise a respective storage unit 60, 62, 64 likewise in the form of a respective shift register 70, 72, 74.

Each shift register 70 to 75 has 8 series-connected flip-flops having a stored content of 1 bit in each case. Consequently, each shift register 70 to 75 provides a stored content of 8 bits. The shift registers 70 to 75 can be written to and read from in parallel.

All the abovementioned operating units 50 to 55 are connected in series one after another via a data line 42, wherein the first operating unit 50 is connected to the central control unit 40. Furthermore, the shift registers 70 to 75 are also connected in series. The interconnection of the individual operating units 50 to 55 and the allocation of the individual operating units 50 to 55 to the floors 12, 14, 16 can also be gathered from the schematic diagram in FIG. 2.

On the basis of this system, a method for setting up the operating units 50 to 55 is explained below.

In a first step, configuration data with an address data packet are transmitted from the control unit 40 to the shift registers (70-75) of the operating units (50-55). The address data packet comprises a large number of addresses for respectively defining an address for each operating unit 50 to 55. By way of example, the values 255 to 1 (255>254>253> . . . >3>2>1) represent the addresses (designated by "ADDRESS" or "DATA" in FIG. 2). A number of values, that is to say addresses, corresponding to the number of operating units 50 to 55 or shift registers 70 to 75 is preferably provided for the address data packet.

Figure 2:
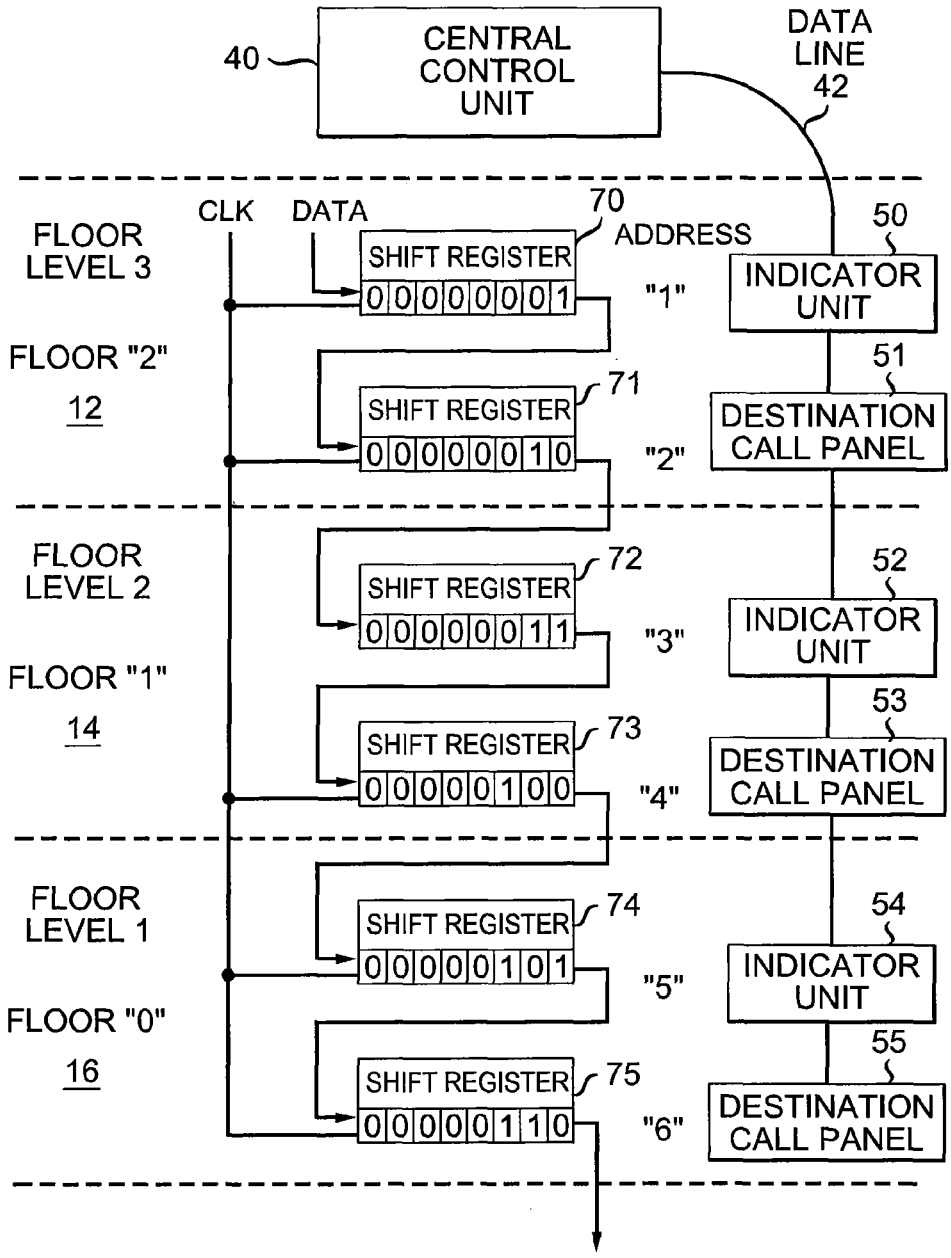
FIG. 2 shows a schematic overview of the steps carried out in the method for setting up the operating units of the elevator system in accordance with FIG. 1.

The addresses are stored in the shift registers 70 to 75 of the storage units 60 to 65 step by step in a manner dependent on a predetermined clock signal, such that, with each clock cycle, the stored content within a shift register 70 to 75 is advanced by one flip-flop (see "CLK" in FIG. 2). In this way, the addresses accommodated in a specific order in the address data packet can be processed, including and transmitted and/or stored, in storage units 60 to 65 in accordance with said order at temporally fixedly predefined time intervals.

Thus, from the address data packet, firstly the first address "255" is stored in the shift register 70 of the first operating unit 50. Afterward, the address "254" is transmitted to the first operating unit 50 and the address "255", which is now at the first position in the address data packet there, is shifted into the shift register 71 of the second operating unit 51. Afterward, the address "253" is transmitted to the first operating unit 50 and the address "254" is shifted there from the shift register 70 into the shift register 71. The address 255 present there is correspondingly shifted into the shift register 72 of the third operating unit 52. These steps are repeated in the same way for all addresses from 255 to 1. The addresses are sent to the first operating unit step by step in the order (255, 254 . . . 2, 1), while the addresses stored in the other shift registers are shifted step by step to the subsequent shift register.

At the end of the method, therefore, the operating unit 50 situated the closest to the control unit 40 has the address "1", the operating unit 51 has the address "2", etc., until finally the operating unit 55 has the address "6". The addresses 7-255 no longer correspond to a register in the present example and are lost.

After an address has been sent to each shift register 70 to 75, the control unit 40 transmits a signal to each operating unit 50 to 55 in order to read out the content of the respective shift registers 70 to 75, store it and thus allocate the predetermined address.

The control unit 40 can thereby recognize the type of operating unit and how many floors the building has.

After an individual address has been allocated to each operating unit 50 to 55, the control unit 40 can ascertain whether all the operating units 50 to 55 are functional. This is because if one of the operating units 50 to 55 is not functional, the configuration method cannot be fully carried out. However it is readily possible to immediately ascertain which of the operating units 50 to 55 is not functioning, such that it can be promptly exchanged. Such a check preferably becomes possible by virtue of the fact that each operating unit 50 to 55 transmits a check signal to the control unit 40 in order to convey its functionality.

Furthermore, it may be provided that each operating unit 50 to 55 transmits an identification signal for the designation of the operating unit 50 to 55 to the control unit 40. Said identification signal can comprise a hardware identifier. It may furthermore be provided that each operating unit 50 to 55 communicates a position data signal for the designation of the floor on which the operating unit is situated to the control unit 40. The control unit 40 thus recognizes which operating unit 50 to 55 is situated at which position or on which floor.

The above-described method for setting up the operating units 50 to 55 is distinguished, in particular, by the fact that separately setting up each operating unit 50 to 55 by means of assembly personnel and by means of moving to all the individual floors 12 to 16 is not necessary for setting up the operating units 50 to 55. With the method according to the invention, this setting up can be effected automatically by a procedure in which the address data packet, on account of the series connection of the operating units 50 to 55, is transmitted successively to the shift registers 70 to 75 of the individual operating units 50 to 55 and the addresses accommodated in the address data packet in a specific order are respectively stored in the individual storage units 60 to 65. At the same time, in the case of possible failure of the configuration method, it is easily possible to ascertain which of the operating units 50 to 55 is possibly defective.

The invention claimed is:

1. A method of setting up a plurality of operating units of an elevator system for a plurality of floors, at least one operating unit allocated to each of the plurality of floors, the plurality of operating units being connected in series, and a first operating unit of the plurality of units being connected to a central control unit, the method comprising:

a) transmitting configuration data via an address data packet from the control unit to the plurality of operating units wherein the address data packet comprises a plurality of addresses for respectively defining an address for each operating unit, b) storing the address in storage units of the operating units.

2. The method of claim 1, wherein the addresses are stored in the address data packet in a specific order and are processed in this order step by step in the storage units.

3. A method of setting up a plurality of operating units of an elevator system for a plurality of floors, at least one operating unit allocated to each of the plurality of floors, the plurality of operating units being connected in series, and a first operating unit of the plurality of units being connected to a central control unit, the method comprising:

a) transmitting configuration data via an address data packet from the control unit to the plurality of operating units wherein the address data packet comprises a plurality of addresses for respectively defining an address for each operating unit; and b) storing an address in a storage unit of each corresponding operating unit, wherein each storage unit comprises a shift register, the shift registers being connected in series and the respective address stored in the respective shift register.

4. The method of claim 3, wherein at least one of step by step transmission and step by step storage is based on a clock signal.

5. The method of claim 1, further comprising each operating unit transmitting a check signal to the control unit.

6. The method of claim 1, further comprising each operating unit transmitting to the control unit at least one of an identification signal for the designation of the operating unit and operating unit properties.

7. The method of claim 1, further comprising each operating unit transmitting a position data for the designation of a floor to the control unit.

8. The method of claim 1, wherein the plurality of operating units comprises at least two groups of operating units, a first group comprising a plurality of destination call units and a second group comprising a plurality of indicator units.

9. An elevator system comprising:

a plurality of operating units connected in series, at least one operating unit of the plurality of operating units being allocated to each of a plurality of floors;

a central control unit connected to a first of the plurality of units;

a transmitter to transmit configuration data via an address data packet from the control unit to the plurality of operating units, the address data packet comprising a plurality of addresses for respectively defining an address for each operating unit; and a storage unit associated with one of the plurality of operating units to store an address of the one of the plurality of operating units.

10. The system of claim 9, wherein the addresses are stored in the address data packet in a specific order, further comprising means for processing the specific order step by step in the storage units.

11. An elevator system comprising:

a plurality of operating units connected in series, at least one operating unit of the plurality of operating units being allocated to each of a plurality of floors;

a central control unit connected to a first of the plurality of units;

a transmitter to transmit configuration data via an address data packet from the control unit to the plurality of operating units, the address data packet comprising a plurality of addresses for respectively defining an address for each operating unit; and a plurality of storage units, each storage unit associated with one of the plurality of operating units, each of the storage units to store an address of one of the plurality of operating units, wherein each storage unit comprises a shift register, each shift register of the plurality of storage units being connected to one another in series, and each respective address stored in a respective shift register.

12. The system of claim 10, wherein means for processing the specific order is based on a clock signal.

13. The system of claim 9, wherein each operating unit further comprises means for transmitting a check signal to the control unit.

14. The system of claim 9, wherein each operating unit further comprises means for transmitting to the control unit at least one of an identification signal for the designation of the operating unit and operating unit properties.

15. The system of claim 9, wherein each operating unit further comprises means for transmitting a position data for the designation of a floor to the control unit.

16. The system of claim 9, wherein the plurality of operating units comprises at least two groups of operating units, a first group comprising a plurality of destination call units and a second group comprising a plurality of indicator units.

* * * * *